US005678694A

United States Patent [19]

Tanaka et al.

[11] Patent Number: 5,678,694

[45] Date of Patent: Oct. 21, 1997

[54] FOOD AND BEVERAGE TRAY

[75] Inventors: Michael K. Tanaka, 1636 Avenida Entoada, San Dimas, Calif. 91773; Masao Morisaku, Pasadena, Calif.

[73] Assignee: Michael K. Tanaka, Covina, Calif.

[21] Appl. No.: 647,170

[22] Filed: May 9, 1996

[51] Int. Cl.[6] ..... B65D 21/00

[52] U.S. Cl. ..... 206/561; 206/564; 206/815

[58] Field of Search ..... 220/574, 575; 206/561, 562, 564, 565, 815

[56] References Cited

U.S. PATENT DOCUMENTS

| | | | |
|---|---|---|---|
| 4,208,006 | 6/1980 | Bixler et al. | 206/564 X |
| 4,461,396 | 7/1984 | Harper | 206/565 X |
| 4,966,297 | 10/1990 | Doty | 206/564 X |
| 5,119,967 | 6/1992 | Ercolani | 206/564 X |
| 5,184,750 | 2/1993 | Moller . | |
| 5,207,743 | 5/1993 | Costarella et al. . | |
| 5,259,528 | 11/1993 | Pace et al. . | |
| 5,346,070 | 9/1994 | McSpadden . | |
| 5,353,952 | 10/1994 | Donche . | |
| 5,390,798 | 2/1995 | Yanuzzi . | |
| 5,419,455 | 5/1995 | Russeau | 206/564 X |
| 5,421,459 | 6/1995 | Mazzotti | 206/564 X |

*Primary Examiner*—Jacob K. Ackun
*Attorney, Agent, or Firm*—Don Finkelstein

[57] ABSTRACT

A food and beverage tray that includes food sections and a beverage section, the latter to hold a beverage container and finger receiving means as a part of the tray in said beverage section wherein at least one finger of a hand may be used to stabilize and hold the beverage container wherein the remaining fingers and palm of the hand hold and stabilize the tray.

9 Claims, 2 Drawing Sheets

FOOD AND BEVERAGE TRAY

BACKGROUND OF THE INVENTION

1. Field of the Invention

This invention relates to a food and beverage tray where one or more fingers can stabilize a beverage container sitting on the tray by direct contact therewith.

2. Description of the Prior Art

There has always been a problem at parties and other events where beverages in containers are served on trays with food also thereon. It may require two hands at times to hold and stabilize the beverage making eating and drinking extremely difficult unless the tray is set down.

There have been various attempts to rectify this problem such as seen in U.S. Pat. Nos. 5,421,459; 5,491,455; 5,390,798; 5,353,95; 5,346,070; 5,259,528; 5,207,743 and 5,184,750. In all of these patents direct finger contact with the beverage cup or glass has not occurred. Most of the prior art requires a hand of the holder to grip a portion of the tray such as a well formed in the tray, see U.S. Pat. No. 5,421,459. In another prior art patent a sleeve is formed on the tray to receive the base of stem wear, see, U.S. Pat. No. 5,419,455. All of the other art operates in some what the same way.

By no direct gripping or wedging of a beverage container there is the great possibility of spilling the beverage or that the container will tip over.

SUMMARY OF INVENTION

It is the purpose of the present invention to provide a food and beverage tray where a finger or fingers of the tray user extend through appropriate tray openings to directly engage a beverage container resting on the tray to help stabilize the container.

Another object of the present invention is to provide a food and beverage tray that includes an interior wall against which a beverage container may be biased by a finger of a hand holding the tray.

A still further object of the present invention is to provide a food and beverage tray wherein the tray has provisions for a plurality of fingers of the hand holding the tray so that the beverage container may be biased by the several fingers and further stabilize the container.

A still further object of the present invention is to provide a food and beverage tray to stabilize a beverage container thereon which may be disposable.

A yet further object of the present invention is to provide a food and beverage tray to stabilize a beverage container thereon which may be permanent and reused.

These and other objects and advantages will become apparent from the following part of the specification wherein details have been described for the competence of disclosure, without intending to limit the scope of the invention which is setforth in the appended claims.

BRIEF DESCRIPTION OF THE DRAWINGS

These advantages may be more clearly understood from the following description and by reference to the drawings in which.

DETAILED DESCRIPTION OF THE PREFERRED EMBODIMENT

Figure 1:
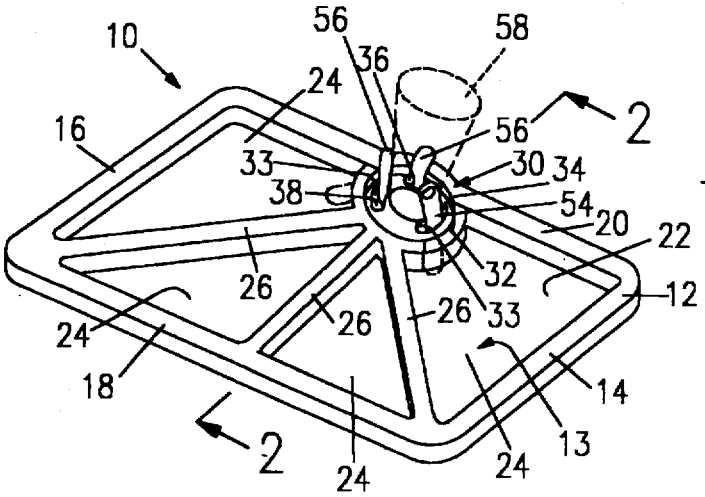
FIG. 1 is a perspective view of a food and beverage tray of the present invention illustrating finger openings to grip a beverage container resting on the tray.

In FIG. 1 there is illustrated a food and beverage tray generally designated 10. The tray 10 may be formed of pressed and molded cardboard or plastic and is usually a disposable tray. In other words the tray 10 is thrown away after one use. However, the tray 10 may be constructed of more sturdy material such as a hard plastic where it may be washed after use and reused.

Preferably the tray 10 is elongated, as shown, or it may be square or another appropriate shape. There is an annular exterior border or marginal peripheral edge wall portion 12 extending around a substantially planar base portion 13 of the tray 10, the peripheral wall portion 12 forming a pair of opposed sides 14 and 16, a front edge 18 and rear edge 20.

Figure 2:
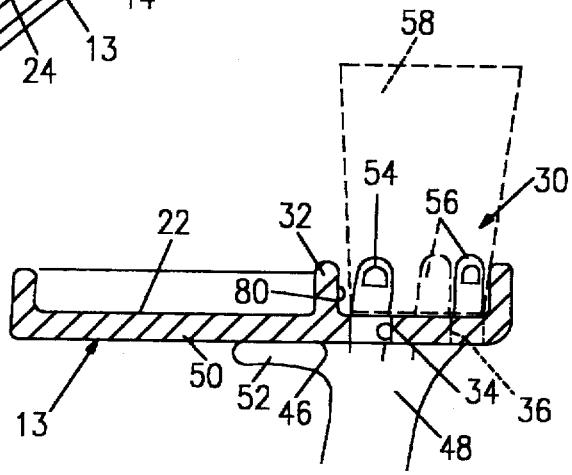
FIG. 2 is a cross sectional view of the food and beverage tray taken on lines 2—2 of FIG. 1.

The planar base portion 13 is in a predetermined geometrical shape which, as shown on FIG. 1 is generally rectangular, and has an upper surface 22 and a lower surface 50. The upper surface 22 extends over the entire area within the upstanding peripheral wall portion 12. As shown on FIG. 1 there are four food sections designated 24 within the peripheral wall portion 12 which are defined by upstanding interior divider wall portion 26 extending in a preselected pattern inwardly from the peripheral wall portion 12. It will be appreciated that more or less than four food sections may be defined by the pattern of the upstanding interior divider wall portion 26. The tray 10 shown in FIG. 1 is also provided with a beverage section 30 defined by upstanding divider wall portion 32 which may be round to define a circular beverage section 30, and the inside surface 80 of the divider wall portion 32 may be straight or tapered. The divider wall portion 32 divides the upper surface 22 of base portion 12 into the beverage section 30 and the one or more food sections 24. As shown more clearly in FIG. 2, in the preferred embodiments of the present invention, the upstanding divider wall 32 and the peripheral wall 12 in regions of the beverage section 30 extend upwardly from the upper surface 22 of the base portion 13 a height greater than the height of the upstanding peripheral wall portion 12 and the interior divider wall portion 26 in other regions of the tray 10. However, if desired, the height of the divider wall 32, the height of the interior divider wall 26 and the height of the peripheral wall 12 may be the same or vary in any desired combination.

As shown on FIG. 1, the divider wall portion 32 abuts the peripheral wall portion 12 to define the enclosed beverage section 30. The height of the peripheral wall portion 12 in the regions where it abuts the divider wall portion 32 may be the same height as the divider wall portion 32 and the remainder of the peripheral wall portion 12 and the interior divider wall portion 26 may be less than the height of the divider wall portion 32. The upper surface 22 of the planar base portion 13 is preferably substantially planar in the beverage section 30 thereof.

Aperture walls 33 are provided in the beverage section 30 of the planar base portion 13 extending therethrough from the lower surface 50 to the upper surface 22.

As shown on FIG. 1, the aperture walls 33 define three arcuate digit accepting openings 34, 36 and 38 which are adapted to receive three digits such as two fingers and the thumb or three fingers of the user of the tray 10. The three digit accepting apertures 34, 36 and 38 are arranged in a predetermined pattern which, in preferred embodiments of the present invention may be an equilateral triangular array and are substantially equally radially spaced from the center of the circular beverage section 30. According to the principles of the present invention, the digit accepting apertures 34, 36 and 38 are free of obstruction thereover above the upper surface 22 of planar base portion 13 to allow the digits of the user to extend therethrough without interference from other structure which would impede the free movement of the digits as they project above the upper surface 22.

In utilizing the tray 10, the palm 46 of a user's hand 48 is placed against the lower surface 50 of the planar base portion 13 and faces upwardly thereagainst so that three digits such as the thumb 54 and two fingers 56 project through the digit accepting apertures 34, 36 and 38. Alternatively, three fingers may be utilized to extend through the digit accepting apertures 34, 36 and 38 with the thumb utilized to brace against the lower surface 50 of the planar base portion 13 as may be desired by the user.

A beverage container 58, shown in dotted lines, may be placed in the beverage section 30 on the upper surface 22 between the thumb 54 and fingers 56, or the three fingers, extending through the apertures 34, 36 and 38 which can then grasp and stabilize the beverage container 58. The remaining digits of the hand 48 and the palm 46 balance the tray 10. This leaves the other hand of the user (not shown) to eat food from the food sections 24 or to take the beverage container 58 from its place on the upper surface 22 of planar base portion 13 so that a drink may be taken therefrom.

The finger openings 34, 36 and 38 are of such universal dimensions as to make the tray 10 adaptable to anyone's use.

Figure 3:
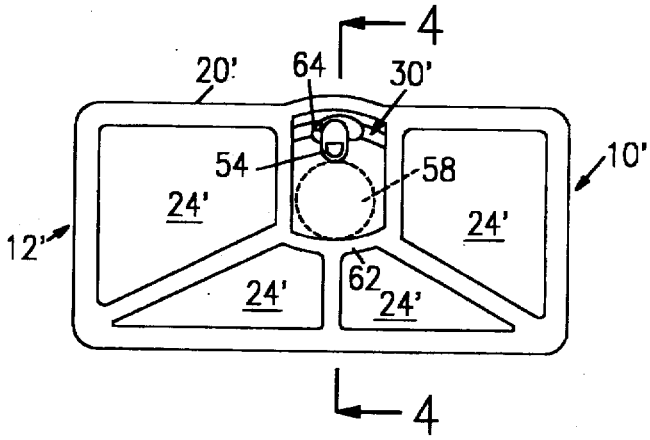
FIG. 3 is a top plan view of a modified food and beverage tray of the present invention illustrating a single finger opening to bias the beverage container against an interior wall of said tray.
Figure 4:
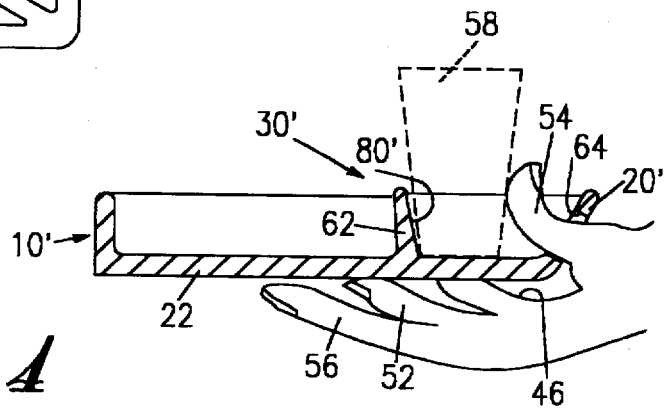
FIG. 4 is a cross sectional view of the food and beverage tray taken on lines 4—4 of FIG. 3.

In FIGS. 3 and 4 there is illustrated a modified tray 10'. The tray has the marginal edge wall 12' and food sections 24'. The distinction resides in the beverage section 30'. In this modification the section is elongated inwardly from the rear edge 20' and has a rounded or arcuate front edge divider wall 62.

The rear edge 20' of marginal wall 12' has a finger receiving means or thumb opening 64 through which the thumb 54 projects. As seen in FIG. 4 it is biased against the cup 58 which pushes the cup 58 against the front wall 62 to stabilize it.

As seen in FIG. 4, the palm 46 and remaining fingers 52 and 56 will be spread out under the tray 10 to stabilize and hold the tray 10.

Again with this arrangement of FIGS. 3 and 4 the other hand of the person holding the tray is free to eat from the tray or remove the cup or container 58 to drink from it.

Figure 5:
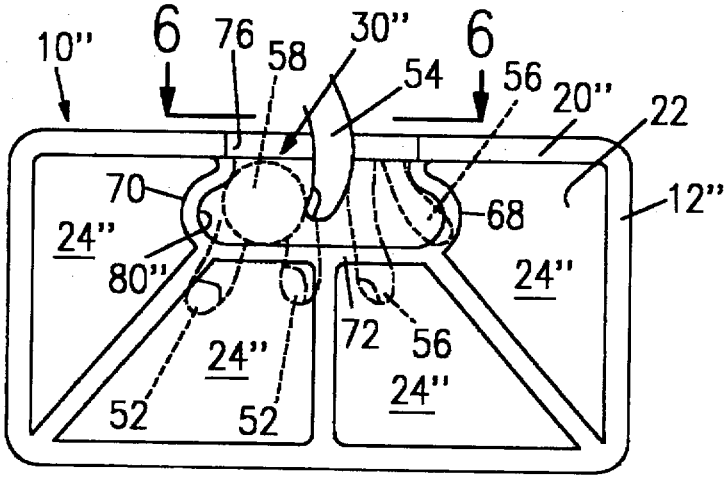
FIG. 5 is a top plan view of a further modified beverage and food tray with a single finger opening to assist in biasing a beverage container mounted thereon against an interior partition wall.
Figure 6:
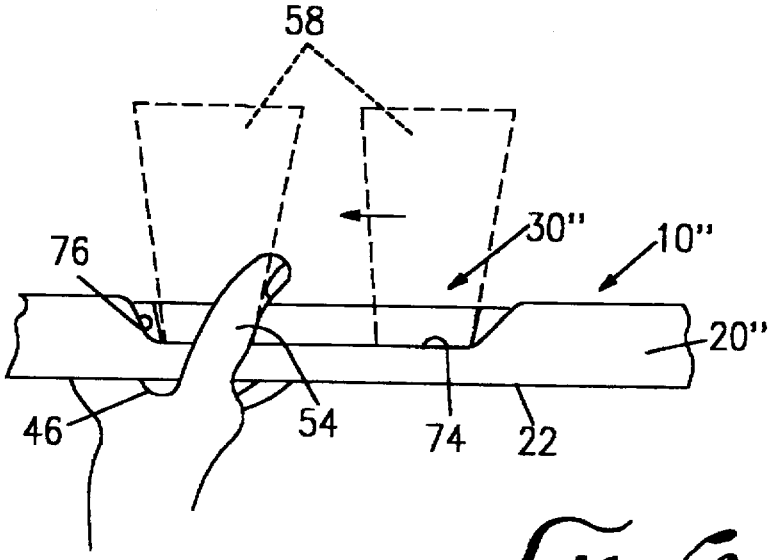
FIG. 6 is a cross sectional view of the food and beverage tray taken on line 6—6 of FIG. 5.

FIGS. 5 and 6 illustrate a further modified tray 10" Again the exterior shape with marginal edge wall 12" and four food sections 24" are provided.

Here the modification again resides in the beverage section 30". In this case the section 30" is laterally elongated running along rear edge 20" with a pair of opposed rounded ends 68 and 70 and a front edge 72 formed by the divider wall.

In order to utilize the thumb 54, see particularly in FIG. 6, there is finger receiving means in the form of a recess or cutout 76 in the rear edge 20" of the marginal edge wall 12". In this way the palm 46 and remaining fingers 52 and 56 may bear against the bottom surface 22 of the tray 10" to stabilize it while the thumb 54 extends upward against the rear edge wall 20", through the recess 76 and against the cup 58 that is biased against the either rounded end 68 or 70 of the beverage section 30".

Again with the arrangement just discussed the tray 10" is stabilized by one hand and the cup 58 is also retained in position, leaving the other hand free to eat or drink. Also with an elongated beverage section the cup 58 may be shifted to the right end 68 or left end 70 depending upon whether the right hand or left hand is used to stabilize the tray and hold the cup 58.

While the tray 10 is described and illustrated with four food sections 24, the same may vary in number depending upon the requirements of the numbers of different foods to be served on the trays.

With regard to the beverage section 30, the interior wall surface 80, 80' or 80" of the respective annular raised divider wall 32, arcuate front edge wall 62 and the opposed rounded ends 68 and 70, they may have an irregular surface. This will assist in the retaining or biasing of the beverage container to prevent tipping.

The invention and its attendant advantages will be understood from the foregoing description and it will be apparent that various changes may be made in the form, construction and arrangements of the parts without departing from the spirit and scope thereof or sacrificing its material advantages, the arrangements herein before described being merely by way of example. We do not wish to be restricted to the specific forms shown or uses mentioned, except as defined in the accompanying claims, wherein various portions have been separated for clarity of reading and not for emphasis.

We claim:

1. An improved food and beverage tray adapted to be supported by the hand of a user, the food and beverage tray including at least one food section and a beverage section, and on which a beverage container is placeable on the beverage section and the beverage container supportable thereon by the grasp of three digits of the hand of the user, said food and beverage tray comprising, in combination:

a substantially planar base portion having a predetermined geometrical shape and having a peripheral edge, and said planar base portion having a bottom surface and a top surface and a preselected thickness between said bottom surface and said top surface;

an upstanding peripheral wall portion extending around said peripheral edge of said planar base portion and extending upwardly from said top surface of said planar base portion a first predetermined height;

an upstanding divider wall portion extending upwardly from said top surface of said planar base portion a second predetermined height and dividing said top surface of said planar base portion into a beverage section and at least one food section, and said divider wall portion abutting said peripheral wall portion to define said beverage section as fully enclosed by said divider wall portion and said peripheral wall portion;

aperture walls defining a plurality of three digit accepting apertures extending through said planar base portion from said bottom surface to said top surface thereof in said beverage section of said planar base portion and said digit accepting apertures in a predetermined spaced array, and said digit accepting apertures free of obstruction thereover in regions above said top surface, and said planar base portion substantially planar in at least said top surface in regions of said beverage section.

2. The arrangement defined in claim 1 wherein:

said predetermined spaced array of said digit accepting apertures is substantially equally spaced in an equilateral triangular array.

3. The arrangement defined in claim 1 wherein:

said digit accepting apertures are spaced in said predetermined spaced array to accept two fingers and a thumb of the hand of a user.

4. The arrangement defined in claim 1 wherein:

said digit accepting apertures are spaced in said predetermined spaced array to accept three fingers of the hand of a user.

5. The arrangement defined in claim 1 wherein:

said first predetermined height of said peripheral wall portion is substantially equal to said second predetermined height of said divider wall portion.

6. The arrangement defined in claim 1 wherein:

said peripheral wall portion has a substantially equal height to said second predetermined height of said divider wall portion in regions bounding said beverage section and said substantially equal height is greater than said preselected height of said divider wall portion in regions other than regions bounding said beverage section.

7. The arrangement defined in claim 1 wherein:

said peripheral wall portion and said divider wall portion define a circular beverage section.

8. The arrangement defined in claim 1 wherein:

said digit accepting apertures are substantially arcuate shaped.

9. The arrangement defined in claim 7 wherein:

said predetermined spaced array of said three digit accepting apertures is substantially equal angular about the center of said circular beverage section and substantially equally radially spaced from the center of said circular beverage section;

said three digit accepting apertures are substantially arcuate;

said first predetermined height of said peripheral wall portion has a substantially equal height to said second predetermined height of said divider wall portion in regions bounding said beverage section and said substantially equal height is greater than said preselected height of said divider wall portion in regions other than bounding said beverage section; and said divider wall portion divides said upper surface of said planar base portion into a plurality of food sections.

* * * * *